US007984756B2

(12) United States Patent
Dowling et al.

(10) Patent No.: US 7,984,756 B2
(45) Date of Patent: Jul. 26, 2011

(54) OVERPRESSURE PROTECTION IN GAS WELL DEWATERING SYSTEMS

(75) Inventors: Michael A. Dowling, Houston, TX (US); Jason Kamphaus, Missouri City, TX (US); Harryson Sukianto, Missouri City, TX (US); Alain P. Dorel, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 73 days.

(21) Appl. No.: 12/372,962

(22) Filed: Feb. 18, 2009

(65) Prior Publication Data

US 2010/0206549 A1 Aug. 19, 2010

(51) Int. Cl.
*E21B 43/00* (2006.01)

(52) U.S. Cl. ..... 166/68; 166/105.6

(58) Field of Classification Search ..... 166/68, 166/68.5, 105, 105.5, 105.6
See application file for complete search history.

(56) References Cited

U.S. PATENT DOCUMENTS

| | | | | |
|---|---|---|---|---|
| 2,708,411 | A | | 5/1955 | Richardson |
| 2,834,300 | A | | 5/1955 | Brock |
| 2,941,629 | A | | 6/1960 | Rohacs |
| 3,183,972 | A | | 5/1965 | Fredd |
| 3,589,838 | A | | 6/1971 | Tuzson |
| 3,912,009 | A | | 10/1975 | Davis, Jr. |
| 4,043,390 | A | | 8/1977 | Glotin |
| 4,184,515 | A | | 1/1980 | Streich et al. |
| 4,275,997 | A | * | 6/1981 | Woodring et al. ..... 417/218 |
| 4,317,485 | A | | 3/1982 | Ross |
| 4,598,630 | A | | 7/1986 | Kao |
| 4,688,999 | A | | 8/1987 | Ames et al. |
| 5,188,517 | A | | 2/1993 | Koster |
| 5,203,172 | A | | 4/1993 | Simpson et al. |
| 5,494,102 | A | * | 2/1996 | Schulte ..... 166/105.6 |
| 5,577,890 | A | | 11/1996 | Nielsen et al. |
| 5,778,978 | A | | 7/1998 | Crow |
| 5,871,051 | A | | 2/1999 | Mann |
| 6,017,198 | A | | 1/2000 | Traylor et al. |
| 6,044,909 | A | | 4/2000 | Gano |
| 6,089,322 | A | | 7/2000 | Kelley et al. |
| 6,196,309 | B1 | | 3/2001 | Estilette, Sr. |
| 6,508,310 | B1 | | 1/2003 | Mioduszewski et al. |
| 6,854,515 | B2 | | 2/2005 | Matthews et al. |
| 7,005,765 | B1 | | 2/2006 | Schulz et al. |
| 7,124,819 | B2 | | 10/2006 | Ciglenec et al. |
| 7,380,608 | B2 | | 6/2008 | Geier |
| 2004/0060705 | A1 | | 4/2004 | Kelley |
| 2004/0084178 | A1 | | 5/2004 | Reid |
| 2006/0083645 | A1 | | 4/2006 | Simmons |

(Continued)

FOREIGN PATENT DOCUMENTS

GB 2099043 A 12/1982

OTHER PUBLICATIONS

U.S. Appl. No. 12/388,098, filed Feb. 18, 2009.

(Continued)

*Primary Examiner* — William P Neuder
(74) *Attorney, Agent, or Firm* — Jim Patterson; Kevin McGoff; Tim Curington

(57) ABSTRACT

Configurations for gas well dewatering systems having overpressure protection to protect a pump and its peripheral equipment from damage due to overpressure are provided.

31 Claims, 6 Drawing Sheets

U.S. PATENT DOCUMENTS

| | | | |
|---|---|---|---|
| 2007/0023191 | A1 | 2/2007 | Dreggevik |
| 2007/0251704 | A1 | 11/2007 | Reimert et al. |

OTHER PUBLICATIONS

U.S. Appl. No. 12/388,211, filed Feb. 18, 2009.
U.S. Appl. No. 12/388,323, filed Feb. 18, 2009.
U.S. Appl. No. 12/388,542, filed Feb. 19, 2009.
Dowling, Michael A. et al, "Monitoring and Control System for a Gas Well Dewatering Pump", U.S. Appl. No. 12/388,542, filed Feb. 19, 2009.
Dowling, Michael A. et al, "Gas Well Dewatering System", U.S. Appl. No. 12/388,098, filed Feb. 18, 2009.
Dowling, Michael A. et al, "Devices, Systems, and Methods for Equalizing Pressure in a Gas Well", U.S. Appl. No. 12/388,211, filed Feb. 18, 2009.
Dowling, Michael A. et al, "Integrated Cable Hanger Pick-Up System", U.S. Appl. No. 12/388,323, filed Feb. 18, 2009.

* cited by examiner

OVERPRESSURE PROTECTION IN GAS WELL DEWATERING SYSTEMS

FIELD

The present application relates generally to gas well dewatering systems. More particularly, the present application relates to overpressure protection in gas well dewatering systems to protect a positive displacement pump, such as a piston pump, and related peripheral equipment from damage due to overpressure.

BACKGROUND

Hydrocarbons and other fluids are often contained within sub-terrain formations at elevated pressures. Wells drilled into these formations allow the elevated pressure within the formation to force the fluids to the surface. However, in low pressure formations, or when the formation pressure has diminished, the formation pressure may be insufficient to force the fluids to the surface. In these cases, a pump can be installed to provide the required pressure to produce the fluids.

A positive displacement pump, such as a piston pump, can be used in a well to create the pressure necessary to continue pumping fluid from low pressure formations. A drawback of conventional piston pumps is that if something blocks or obstructs the fluid flow, such as a shut valve or a frozen line, the pump will continue to increase pressure until the pump breaks or another system failure such as a leak occurs.

SUMMARY

Gas well dewatering systems having overpressure protection are provided.

In one example, a piston pump is configured to pump well fluid from a reservoir to an outlet, such as a well annulus, for discharge from the well. The piston pump includes a piston that is driven in reciprocal motion in a cylinder. An inlet check valve allows flow of fluid from the well fluid reservoir to the cylinder during upstroke of the piston. An outlet check valve allows flow of fluid from the cylinder to the outlet for discharge during downstroke of the piston. A relief valve is disposed in the piston and biased into a closed position. The relief valve is configured to open and allow flow of fluid from the cylinder when fluid pressure in the cylinder exceeds the bias.

In another example, the relief valve and inlet check valve share a common pathway so that emission of fluid through the relief valve can clear debris that may be impeding flow of fluid from the well reservoir to the cylinder.

In another example, a hydraulic circuit is connected to the piston to supply hydraulic pressure for driving the piston. A relief valve is disposed in the hydraulic circuit and is biased into a closed position. The relief valve is configured to open and allow circulating flow of fluid in the hydraulic circuit when fluid pressure in the cylinder exceeds the bias.

In another example, a relief valve is provided in a conduit connecting the interior of a tubing head located at the surface of the well to the annulus located in an elongated well casing in the well. The relief valve is biased into a closed position and configured to open upon an increase in pressure in the tubing beyond the bias pressure.

In another example, a sand screen is provided in the form of a basket that is retrievable from the well along with the piston pump.

BRIEF DESCRIPTION OF THE DRAWINGS

The best mode of carrying out the invention is described herein, with reference to the following drawing figures.

DETAILED DESCRIPTION OF THE DRAWINGS

In the following description, certain terms have been used for brevity, clearness, and understanding. No unnecessary limitations are to be implied therefrom beyond the requirement of the prior art because such terms are used for descriptive purposes only and are intended to be broadly construed. The different systems described herein may be used alone or in combination with other systems. It is to be expected that various equivalents, alternatives, and modifications are possible within the scope of the appended claims.

Figure 1:
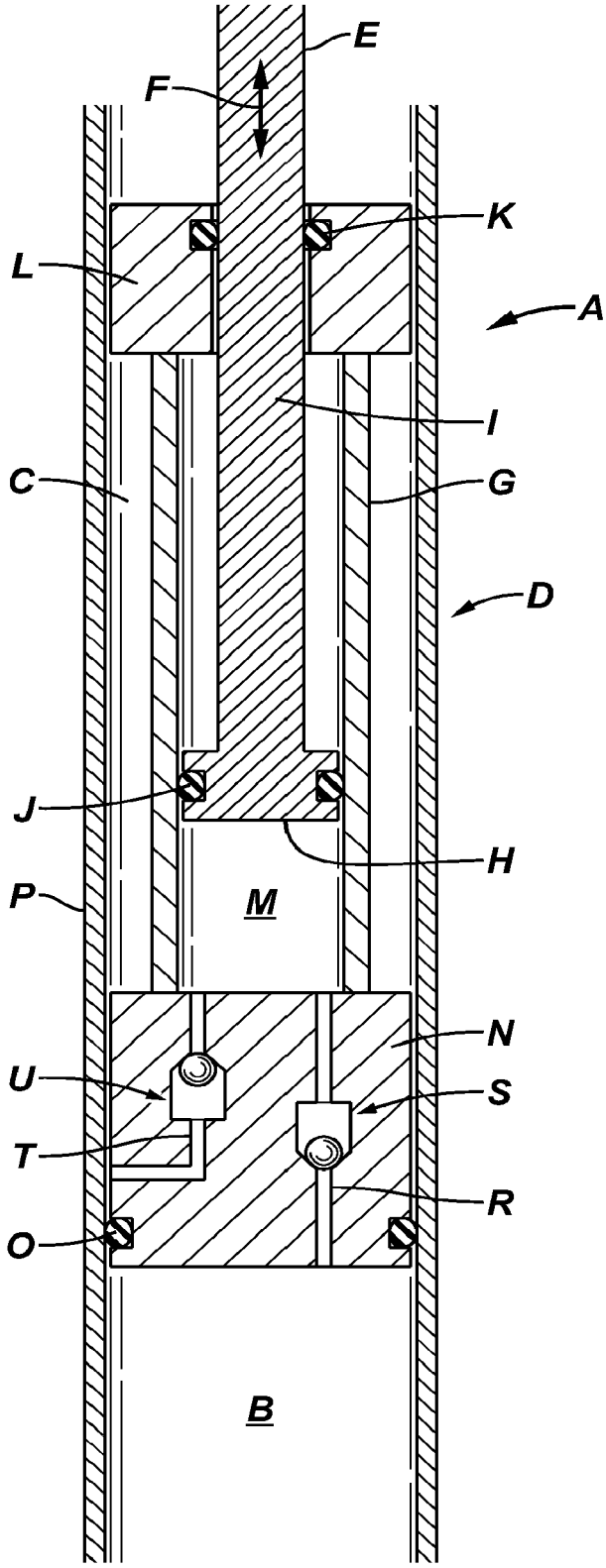
FIG. 1 PRIOR ART
FIG. 1 depicts a conventional piston pump system.

FIG. 1 depicts a conventional piston pump A, which is configured to pump well fluid from a reservoir B to an annulus C for discharge from a well D. The piston pump has a piston E that is driven in reciprocal motion shown by arrows F in a cylinder G. The piston E has a head H and a rod I. One or more seals J seal between the outer surface of head H and the inner surface of cylinder G. Seals J define a moving boundary of pumping fluid chamber M. One or more seals K seal between the outer surface of rod I and piston block L.

Piston block N includes one or more seals O sealing between block N and the inside surfaces of well casing or tubing P and separating the well fluid reservoir B from outlet C. Through-bore R extends through the lower block N from the reservoir B to the pumping fluid chamber M. An inlet check valve S controls flow of fluid through through-bore R, as will be described further below. Through-bore T extends through lower block N from pumping chamber M to outlet annulus C. An outlet check valve U controls flow of fluid from fluid chamber M to outlet annulus C, as will be described further below.

Piston E is driven in reciprocal motion shown by arrows F along the internal length of cylinder G. During upstroke of the piston E, well fluid is drawn from reservoir B into pumping fluid chamber M via through-bore R. Inflow pressure causes inlet check valve S to open and thereby permit flow of fluid through through-bore R. During this time, outlet check valve U is biased by the difference in pressure between fluid chamber M and outlet C into a closed position, thereby preventing flow of fluid out through through-bore T.

Upon downstroke of piston E, the pressure inside fluid chamber M increases an amount greater than the pressure in through-bore R downstream of inlet check valve S, thus causing the inlet check valve S to close and preventing fluid flow through through-bore R. The increase of pressure in fluid chamber M further causes outlet check valve U to open, thereby permitting flow of fluid through through-bore T from the chamber M to the outlet annulus C for discharge at the surface of the well D. The above-described process occurs repeatedly, thus extracting well fluid from the reservoir B and pumping said fluid into the discharge annulus P for discharge from the well.

Although FIG. 1 illustrates a single action piston pump, it should be recognized that a dual action piston can also be used to accomplish the objectives described herein. A dual acting piston pump would have two heads H (i.e. upper and lower heads) and acts to fill and discharge two pumping fluid chambers M (i.e. upper and lower pumping chambers). One chamber is pumped into discharge while the other is simultaneously filled and vice versa. This results in higher flow capacity, but generally results in a more complex system. Several of the figures described herein indicate dual action piston pumps; however, this too does not limit the applicability of the present invention.

FIGS. 2-6 depict examples of dewatering systems including piston pumps having overpressure protection and configured to pump well fluid for discharge from a well. The systems are configured to protect the piston pump and related peripheral equipment from damage due to overpressure, which as described above, can be caused by a blocked line, shut valve, frozen surface line, and the like. When these types of blockages occur, conventional piston pumps continue to operate to create enough pressure in the system to move fluid from upstream to downstream. Without a suitable safety or overpressure protection system, the piston pump would operate until something breaks or a failure occurs. The following examples provide unique solutions to these problems.

Figure 2:
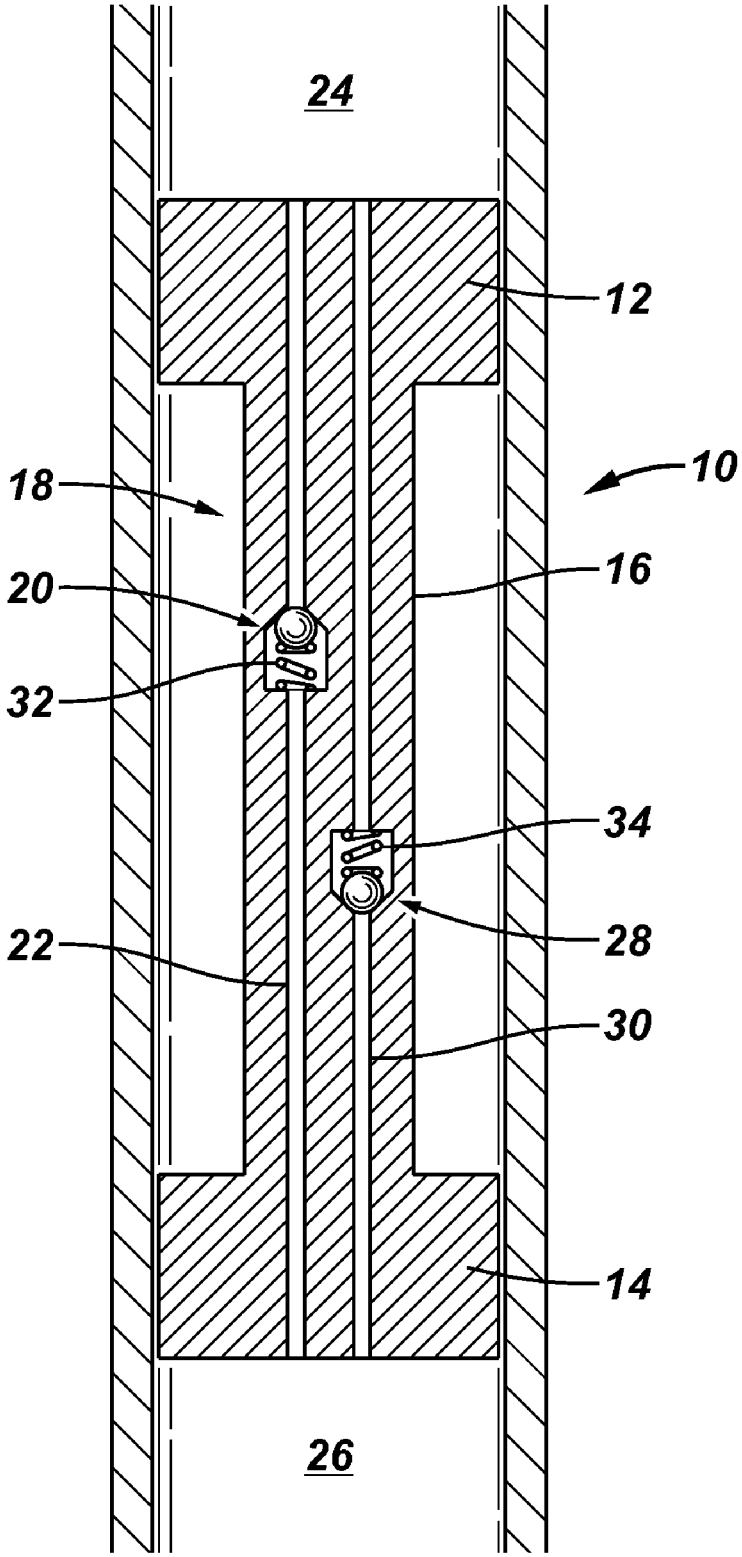
FIG. 2 depicts a piston wherein a relief valve is disposed in the piston and biased into a closed position.

FIG. 2 depicts a dual action piston 10 having an upper piston head 12, a lower piston head 14, and a piston rod 16. This piston 10 is shown schematically and is suitable for use in a conventional gas well dewatering system such as the system depicted in FIG. 1 having a piston pump configured to pump well fluid from a reservoir to an annulus for discharge from the well. This piston 10 includes an overpressure protection relief valve mechanism 18 disposed in the piston 10. The relief valve mechanism 18 includes an upstroke relief valve 20 disposed in a first through-bore 22 that extends from an upper fluid chamber 24 to a lower fluid chamber 26. The upstroke relief valve 20 is biased into a closed position and configured to open when the pressure in the upper fluid chamber 24 exceeds the bias pressure. In the example shown in FIG. 2, the upstroke relief valve 20 is disposed in the piston 10 between the upper piston head 12 and lower piston head 14. The relief valve mechanism 18 also includes a downstroke relief valve 28 disposed in a second through-bore 30 that extends from the upper fluid chamber 24 to the lower fluid chamber 26. The downstroke relief valve 28 is biased into a closed position and is configured to open when the pressure in the lower fluid chamber 26 exceeds the bias pressure. In the example shown, the downstroke relief valve 28 is disposed in the piston 10 between the upper piston head 12 and lower piston head 14.

During operation, the piston 10 is driven in reciprocal motion in a cylinder (such as G, FIG. 1). An inlet check valve (such as S, FIG. 1) allows flow of fluid from a well fluid reservoir (such as B, FIG. 1) to the lower fluid chamber 26 during upstroke of the piston 10. An outlet check valve (such as U, FIG. 1) allows flow of fluid from the lower fluid chamber 26 to a well annulus discharge (such as P, FIG. 1) during downstroke of the piston 10. The structures and functions described above are mirrored for the upper piston head 12.

The relief valve mechanism 18 is configured to allow flow of fluid from the upper fluid chamber 24 to the lower fluid chamber 26 when the pressure in the upper fluid chamber 26 exceeds a bias pressure on the upstroke relief valve 20. In the embodiment shown, the bias pressure is created by a spring 32. Similarly, the downstroke relief valve 28 is configured open and allow flow from the lower fluid chamber 26 to the upper fluid chamber 24 when pressure in the lower fluid chamber 26 exceeds a bias pressure on the downstroke relief valve 28. In the example shown, the downstroke relief valve 28 is biased into the closed position by a spring 34, which determines the bias pressure.

The relief valve mechanism 18 thus prevents overpressure in either of the upper or lower fluid chambers 24, 26 by allowing for flow of fluid amongst the respective chambers at overpressure. Placement of the relief valve mechanism 18 inside of the piston 10 provides a simple arrangement, which saves space in the crowded well environment.

Figure 3:
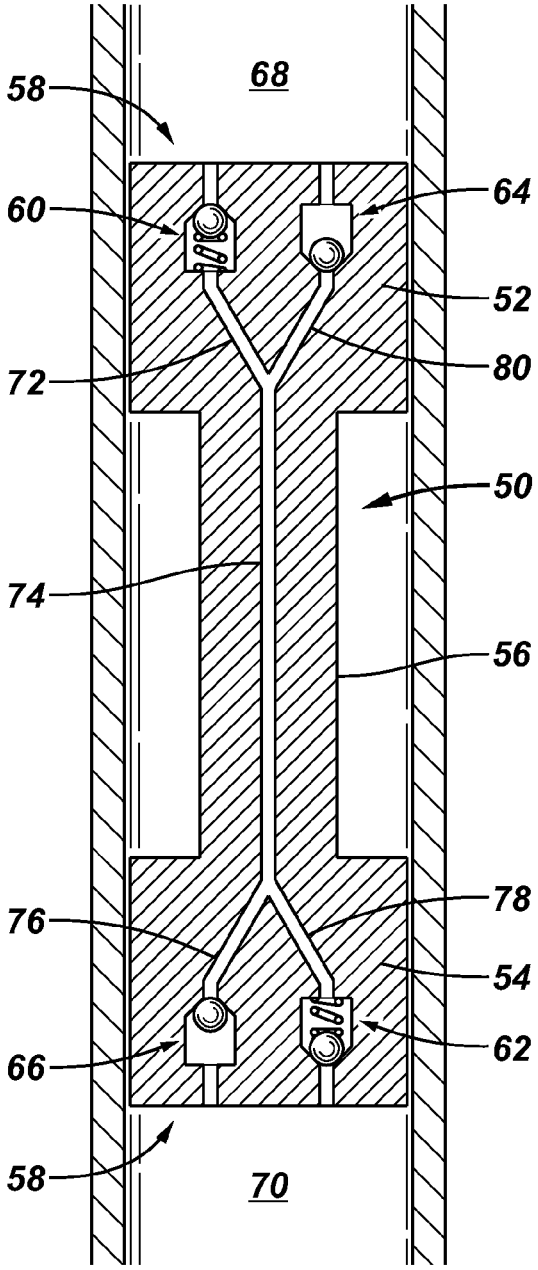
FIG. 3 depicts another example of a piston wherein a relief valve is disposed in the piston and biased into a closed position.

FIG. 3 shows another example of a piston 50, which like the example in FIG. 2 includes an upper piston head 52 and a lower piston head 54 disposed on either end of a piston rod 56. An overpressure protection relief valve mechanism 58 includes an upstroke relief valve 60 disposed in the upper piston head 52 and a downstroke relief valve 62 disposed in the lower piston head 54. A downstroke check valve 64 is contained in the upper piston head 52 and an upstroke check valve 66 is located in the lower piston head 54.

During upstroke of the piston 50, fluid flow from the upper fluid chamber 68 to the lower fluid chamber 70 is prevented by the bias on upstroke relief valve 60 and the downstroke check valve 64. If, however, the pressure in the upper fluid chamber 68 becomes greater than the bias on the upstroke relief valve 60, the valve 60 opens and fluid flows along through-bore 72 to through-bore 74, to through-bore 76 and into the lower fluid chamber 70 via upstroke check valve 66. Fluid flow is prevented through through-bore 78 by downstroke relief valve 62 which is biased into a closed position.

During downstroke of the piston 50, fluid flow through the piston 50 is prevented by the upstroke check valve 66 and the downstroke relief valve 62, which is biased into a closed position. If the pressure in the lower fluid chamber 70 becomes greater than the bias pressure on downstroke relief valve 62, the valve 62 opens and allows fluid to flow along through-bore 78 to through-bore 74, to through-bore 80 and into the upper fluid chamber 68 via downstroke check valve 64. This example thus provides efficiency by employing a single through-bore 74 utilized during pressure relief action for both upstroke and downstroke of the dual acting piston 50. This arrangement is convenient in embodiments wherein the piston rod has a relatively long length, narrow diameter, and wherein it would be otherwise difficult to manufacture a piston rod having multiple through-bores.

Figure 4:
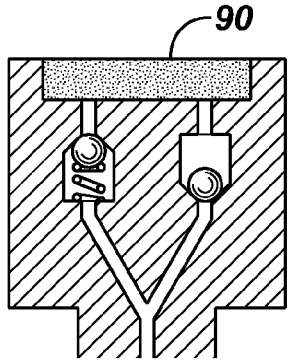
FIG. 4 depicts a piston head having a filter.

As shown in FIG. 4, either of the examples depicted in FIG. 2 or 3 could employ a filter 90 configured to filter fluid flow through the various through-bores. This arrangement helps to prevent solids from plugging the respective valve mechanisms.

Figure 5:
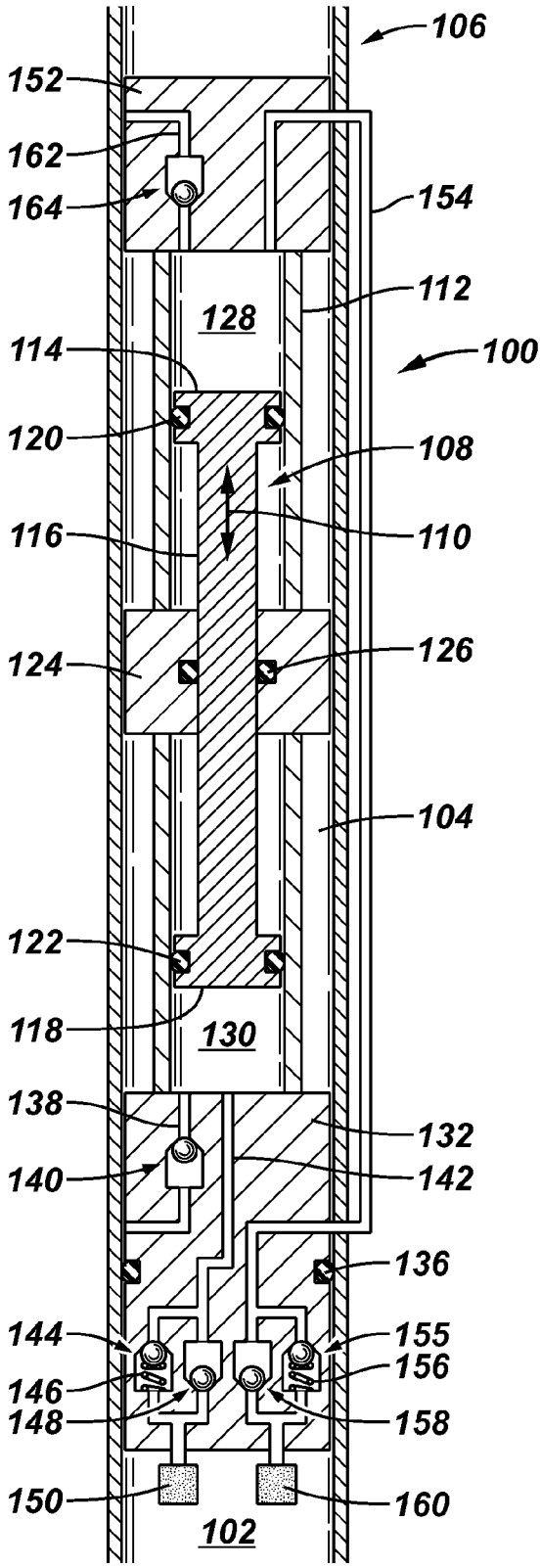
FIG. 5 depicts a gas well dewatering system wherein a relief valve and inlet check valve share a common pathway so that emission of fluid out through the relief valve can clear debris that may be impeding inflow of fluid from the well reservoir to the cylinder.

FIG. 5 depicts another example of a piston pump 100 configured to pump well fluid from a reservoir 102 to an outlet annulus 104 for discharge from a well 106. A dual acting piston 108 is driven in reciprocal motion shown by arrows 110 in a cylinder 112. The piston 108 includes an upper head 114, a piston rod 116, and a lower head 118. One or more seals 120 seal between the upper head 114 and the interior of cylinder 112. The seals 120 define a moving boundary in an upper well fluid chamber 128. One or more seals 122 seal between lower head 118 and the interior of cylinder 112. The seals 122 define a moving boundary in a lower well fluid chamber 130. The piston rod 116 extends through a center block 124 and one or more seals 126 seal between the piston rod 116 and center block 124.

A lower block 132 separates the lower fluid chamber 130 from an outlet or tubing/tool discharge annulus 104. One or more seals 136 are provided between the lower block 132, the discharge annulus 104 and the well fluid reservoir 102.

Lower block 132 contains a through-bore 138 extending from lower well fluid chamber 130 to outlet annulus 104. A lower outlet check valve 140 is positioned in the through-bore 138 to allow fluid flow from the lower well fluid chamber 130 to the outlet annulus 104 and to prevent fluid flow from the annulus 104 to the lower well fluid chamber 130. A through-bore 142 extends through the block 132 from the lower well fluid chamber 130 to the reservoir 102. The through-bore 142 includes a lower relief valve 144 biased into a closed position by a spring 146 to prevent fluid flow. The through-bore 142 also includes a lower inlet check valve 148 preventing fluid flow from the lower well fluid chamber 130 to the reservoir 102. The lower relief valve 144 and lower inlet check valve 148 are set in parallel within through-bore 142. A lower inlet screen 150 filters solid particles from fluid flowing into through-bore 142 from reservoir 102.

An upper block 152 separates the upper well fluid chamber 128 from the outlet annulus 104. A hydraulic line 154 extends from the upper well fluid chamber 128, through the upper block 152, through the lower block 132 and to the reservoir 102. An upper relief valve 155 is disposed in the hydraulic line 154 and biased into a closed position by a spring 156. An upper inlet check valve 158 is also disposed in the hydraulic line 154 and prevents flow of fluid from the upper well fluid chamber to the reservoir 102 via the hydraulic line 154. The upper relief valve 155 and upper inlet check valve 158 are positioned in parallel in the hydraulic line 154. An upper inlet screen 160 filters solids from fluid flowing into hydraulic line 154 from reservoir 102. A through-bore 162 extends through upper block 152 from upper well fluid chamber 128 to outlet annulus 104. An upper outlet check valve 164 is disposed in through-bore 162 to prevent fluid flow from the outlet annulus 104 into the upper well fluid chamber 128.

During operation, the dual acting piston 108 is driven to reciprocate in the direction of arrows 110. During upstroke, fluid is drawn from well reservoir 102 into lower well fluid chamber 130 via conduit 142. Specifically, fluid flows through lower inlet screen 150, wherein the fluid is filtered, then through lower inlet check valve 148 and then into lower well fluid chamber 130. Fluid flow is prevented from flowing through lower relief valve 144, which is biased into closed position by spring 146. Simultaneously, during the upstroke, fluid in upper well fluid chamber 128 is pumped by piston 108 into outlet annulus 104 via through-bore 162 and more specifically through upper outlet check valve 164.

During upstroke, if the upper outlet check valve 164, through-bore 162, annulus 104, or other component becomes blocked or otherwise prevents flow, the pressure inside the upper well fluid chamber 128 will increase because of the movement of piston 108. If that pressure increases beyond the pressure of the bias on upper relief valve 155, upper relief valve 155 will open against the bias of spring 156 and fluid flow will be permitted from upper well fluid chamber 128, through hydraulic line 154, and through upper inlet screen 160.

During downstroke of piston 108, fluid is drawn from reservoir 102 through upper inlet screen 160, upper inlet check valve 158 and through-bore 154 to upper well fluid chamber 128. Simultaneously, piston 108 pushes fluid out of lower well fluid chamber 130 via through-bore 138 and lower outlet check valve 140 to the outlet annulus 104 for discharge from the well 106.

If the through-bore 138, lower outlet check valve 140, outlet annulus 104 or other related equipment becomes blocked, damaged, or otherwise incapable of supporting flow, the piston 108 will cause pressure in the lower well fluid chamber 130 to increase. If this pressure increases beyond the bias pressure against lower relief valve 144, fluid flow will be allowed from the lower well fluid chamber 130 to the through-bore 142, past the lower relief valve 144 and into the reservoir 102 via the lower inlet screen 150.

During operation, the lower inlet screen 150 and upper inlet screen 160 will tend to collect solid matter present in the fluid stream flowing therethrough. This solid matter, such as particulate matter, can accumulate near the intake and cause blockage of flow and negatively affect the life of the piston pump 100 and related seals. The debris caught in the respective screens 150, 160 needs to be cleared periodically to prevent blockage of flow at the intake. According to the present application, it is recognized that closing one side of the system by, for example, closing a valve and blocking flow from the outlet of the well (not shown), will cause a pressure increase in one of the upper well fluid chamber or lower well fluid chamber, thus resulting in an outflow of fluids at the respective inlet screen 150, 160. This outflow of fluid is utilized to clear a particulate matter caught in the screen. By controlling the bore sizes of the related through-bores, the velocity of the exit fluid can be increased to the point that it effectively flushes the respective inlet screen.

Figure 6:
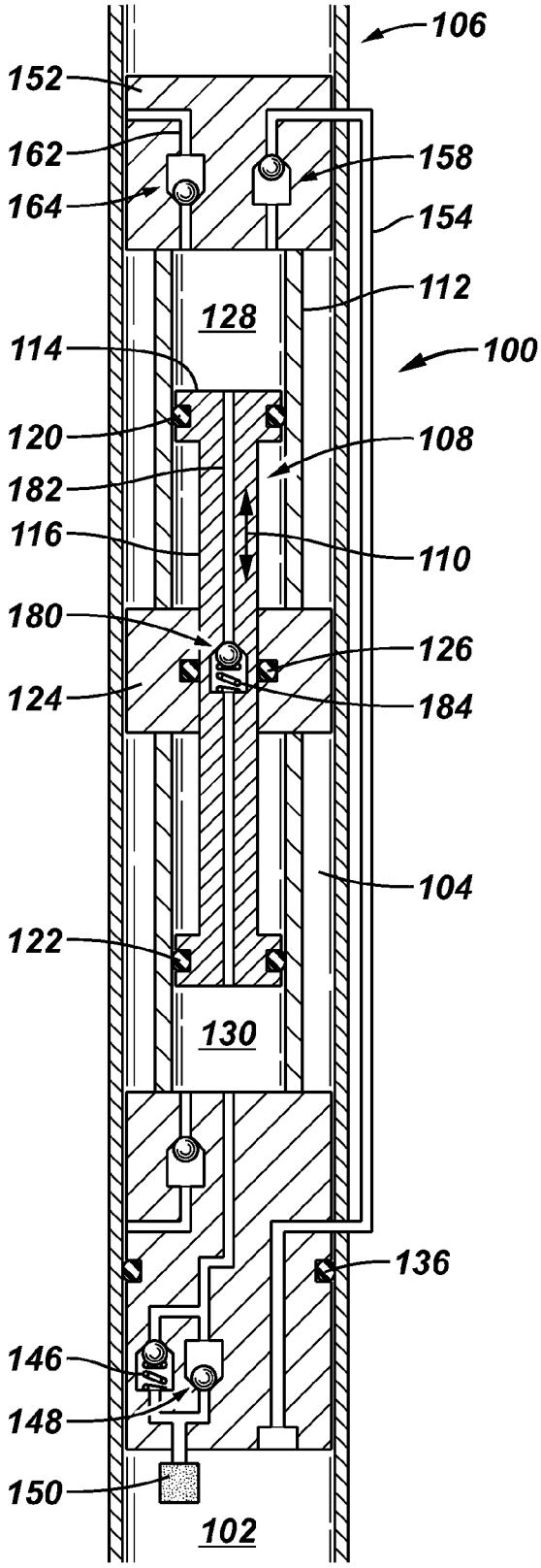
FIG. 6 depicts a gas well dewatering system wherein a relief valve is disposed in a piston that is driven in reciprocal motion in a cylinder; wherein the relief valve and an inlet check valve share a common pathway so that emission of fluid out through the relief valve can clear debris that may be impeding inflow of fluid from the well reservoir to the cylinder.

FIG. 6 depicts an example similar to that depicted in FIG. 5. Like structures in FIG. 6 are depicted with like reference numbers from FIG. 5. The example shown in FIG. 6 differs in that an upper relief valve 180 is disposed in the piston 108, and specifically in a through-bore 182 extending from the upper well fluid chamber 128 to the lower well fluid chamber 130. The upper inlet check valve 158 is disposed in the upper block 152. During operation, the piston 108 is driven to reciprocate in the direction of arrows 110. If flow out of the upper well fluid chamber 128 is blocked, an increase in pressure in the upper well fluid chamber 128 greater than the bias caused by the spring 184 on upper relief valve 180, the relief valve 180 will open and allow fluid to circulate from the upper well fluid chamber 128 to the lower well fluid chamber 130, thereby preventing overpressure and damage caused thereby to the piston pump 100. During downstroke, the upper relief valve 180 is biased into the closed position, thus preventing fluid flow through through-bore 182. Otherwise, the piston pump shown in FIG. 6 operates similarly to the piston pump described hereinabove with reference to FIG. 5. Placement of the relief valve 180 inside of the piston 108 saves space in the crowded well environment and thereby creates efficiency.

Figure 7:
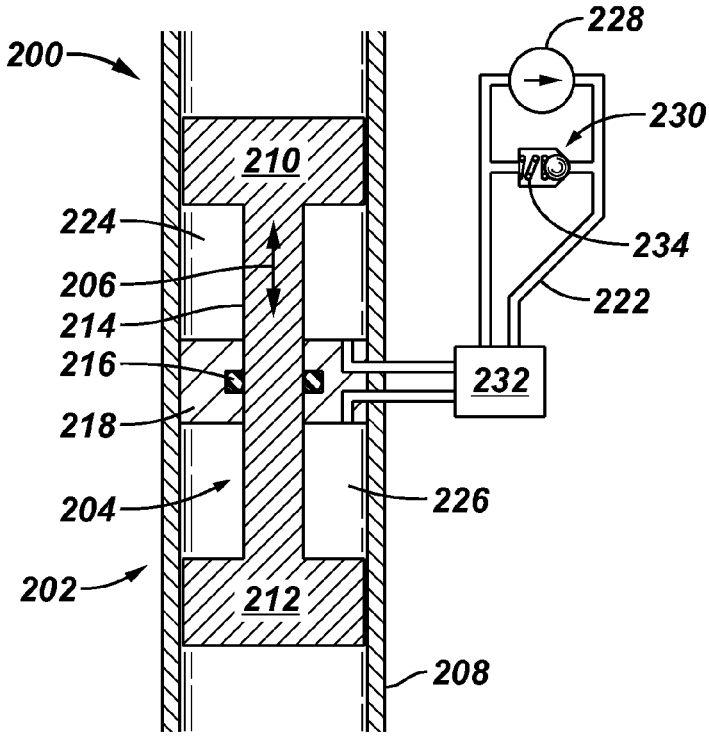
FIG. 7 depicts a gas well dewatering system wherein a hydraulic circuit is connected to a piston to supply hydraulic pressure for driving the piston and a relief valve is configured to open and allow circulating flow of fluid in the hydraulic circuit when fluid pressure in the cylinder exceeds a bias on the relief valve.

FIG. 7 depicts another example of a gas well dewatering system having overpressure protection. The system 200 includes a hydraulic pressure system having a relief valve protecting against overpressure. A piston pump 202, which is configured to pump well fluid from a reservoir to an annulus for discharge from a well includes a dual action piston 204 that is driven in reciprocal motion shown by arrows 206 in a cylinder 208. This piston 204 has upper and lower heads 210, 212 connected by a rod 214. Seals 216 seal between the outer surface of rod 214 and a piston block 218. Piston heads 210, 212 seal with the inner surface of cylinder 208 by conventional means. A hydraulic circuit 222 is connected to the piston pump 202. Specifically, hydraulic circuit 222 is connected to each inner chamber 224, 226. A source of hydraulic pressure 228 is connected to the circuit 222 intermediate the chambers 224, 226. A relief valve 230 is connected to the opposite sides of the hydraulic circuit 222 with respect to the source of hydraulic pressure 228. A switching mechanism 232 is also connected to opposite sides of the hydraulic circuit 222 with respect to the source of hydraulic pressure 228. The relief valve 230 is biased into a closed position and configured to open and allow circulation of fluid from high to low pressure sides of the hydraulic circuit 222 when fluid pressure on the high pressure side exceeds a bias on the relief valve provided by, for example, a spring 234.

In use, the switch 232 alternates to alternately provide high pressure to chambers 224, 226, thereby driving the piston into reciprocal motion shown by arrows 206. As stated above, the relief valve 234 protects against overpressure within the hydraulic circuit 222.

Figure 8:
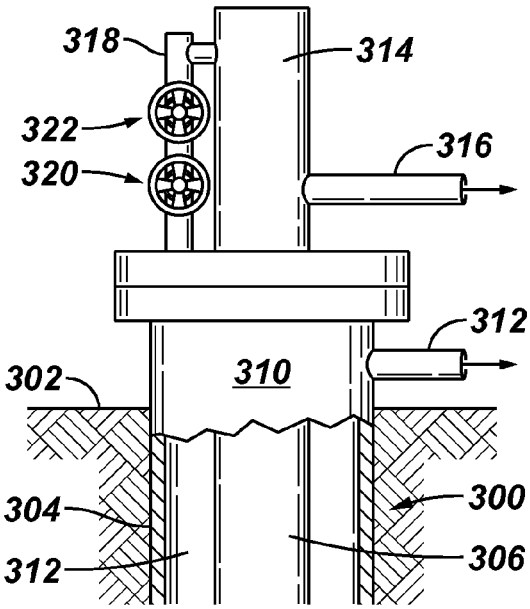
FIG. 8 depicts a casing head and tubing head having a relief valve configured to open upon an increase in pressure in the tubing beyond a bias pressure.

FIG. 8 depicts another example of a gas well dewatering system having overpressure protection. A gas well 300 extends from the surface 302 underground and has an elongated well casing 304 that circumscribes a length of production tubing 306. A pump (not shown) is connected to the length of tubing and configured to pump well fluid from an annulus in the well to the tubing 306 for discharge from the well 300. A casing head 310 is located at the surface 302 and has a discharge 312 for emitting gas from the annulus 312. A tubing head 314 is located at the surface 302 and has a discharge 316 for emitting water from the production tubing 306. A conduit 318 connects the interior of the tubing head 314 to the annulus 312 in the casing 304. A relief valve 320 is disposed in the conduit 318 and biased into a closed position and configured to open upon an increase of pressure in tubing 306 beyond the bias pressure. An isolation valve 322 is also disposed in the conduit 318 between the relief valve and the tubing head 314.

Figure 9:
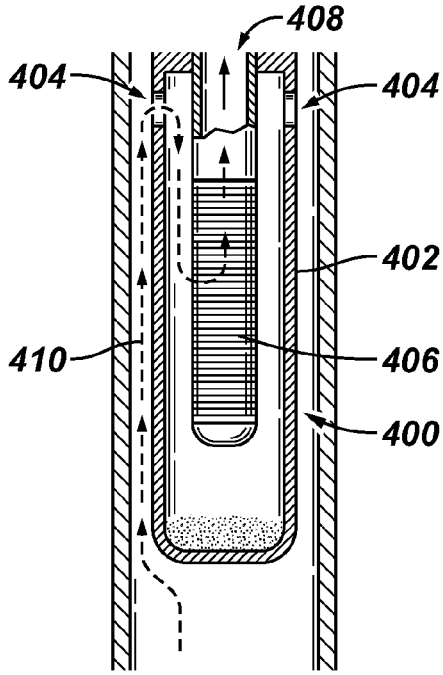
FIG. 9 depicts a basket and sand screen that can be coupled to a piston pump such that the basket is removed from the well when the piston pump is removed from the well.

FIG. 9 depicts a sand catching device 400 configured to collect particulates from fluid flow at the intake of a pump, such as the examples depicted and described above. The device 400 includes a basket 402 configured to be pulled to the surface along with the aforementioned pump when there is a need to replace or repair, or otherwise access the pump. This embodiment allows for easy removal of particulates, while eliminating extra trips downhole. The basket can be custom-sized based upon expected solids production and desired time between maintenance or replacement. Fluid enters the basket 402 via fluid entry ports 404 (arrow 410) and further flows through particle filter or screen 406 and vents onto the aforementioned pump via fluid entry 408.

What is claimed is:

1. A gas well dewatering system having overpressure protection, the gas well dewatering system comprising:

a piston pump configured to pump well fluid from a reservoir to an outlet for discharge from the well, the piston pump having a piston that is driven in reciprocal motion in a cylinder;

an inlet check valve allowing flow of fluid from the well fluid reservoir to the cylinder during upstroke of the piston;

an outlet check valve allowing flow of fluid from the cylinder to the outlet during downstroke of the piston; and a relief valve disposed in the piston and biased into a closed position, the relief valve configured to open and allow flow of fluid from the cylinder when fluid pressure in the cylinder exceeds the bias.

2. The gas well dewatering system of claim 1, wherein the piston pump comprises a dual acting piston having upper and lower piston heads and wherein upper and lower fluid chambers are at least partially defined by the cylinder and the respective upper and lower piston heads.

3. The gas well dewatering system of claim 2, comprising a lower inlet check valve allowing flow of fluid from the well fluid reservoir to the lower fluid chamber during upstroke of the piston and a lower outlet check valve allowing flow of fluid from the lower fluid chamber during downstroke of the piston.

4. The gas well dewatering system of claim 3, comprising an upper inlet check valve allowing flow of fluid from the well fluid reservoir to the upper fluid chamber during downstroke of the piston and an upper outlet check valve allowing flow of fluid from the upper fluid chamber during upstroke of the piston.

5. The gas well dewatering system of claim 4, wherein the relief valve is biased into the closed position by a spring.

6. The gas well dewatering system of claim 4, wherein the relief valve comprises an upstroke relief valve and a downstroke relief valve.

7. The gas well dewatering system of claim 6, wherein the upstroke relief valve is disposed in a first through-bore that extends from the upper fluid chamber to the lower fluid chamber, the upstroke relief valve biased into a closed position and opening when the pressure in the upper fluid chamber exceeds the bias.

8. The gas well dewatering system of claim 7, wherein the upstroke relief valve is disposed in the piston between the upper and lower piston heads.

9. The gas well dewatering system of claim 7, wherein the downstroke relief valve is disposed in a second through-bore that extends from the upper fluid chamber to the lower fluid chamber, the downstroke relief valve biased into a closed position and opening when the pressure in the lower fluid chamber exceeds the bias.

10. The gas well dewatering device of claim 9, wherein the downstroke relief valve is disposed in the piston between the upper and lower piston heads.

11. The gas well dewatering device of claim 9, wherein the upstroke relief valve is disposed in the upper piston head and the downstroke relief valve is located in the lower piston head and the first and second through-bores are at least partially merged.

12. The gas well dewatering device of claim 11, further comprising an upstroke check valve located in the lower piston head and disposed in a third through-bore connected to the first through-bore.

13. The gas well dewatering device of claim 11, further comprising a downstroke check valve located in the upper piston head and disposed in a fourth through-bore connected to the second through-bore.

14. The gas well dewatering device of claim 12 further comprising at least one filter configured to filter fluid flow through the relief valve.

15. The gas well dewatering device of claim 14, wherein the filter is incorporated into the piston.

16. The gas well dewatering device of claim 15, wherein the filter is incorporated into one of the upper and lower piston heads.

17. The gas well dewatering system of claim 1, comprising a screen upstream of the inlet check valve for collecting debris.

18. The gas well dewatering system of claim 17, wherein the screen comprises a basket that is coupled to the piston pump such that the basked is removed from the well when the piston pump is removed from the well.

19. A gas well dewatering system having overpressure protection, the gas well dewatering system comprising:

a piston pump configured to pump well fluid from a reservoir to an annulus for discharge from the well, the piston pump having a piston that is driven in reciprocal motion in a cylinder;

an inlet check valve allowing flow of fluid from the well fluid reservoir to the cylinder during upstroke of the piston;

an outlet check valve allowing flow of fluid from the cylinder to the well annulus discharge during downstroke of the piston; and a relief valve biased into a closed position, the relief valve configured to open and allow flow of fluid from the cylinder when fluid pressure in the cylinder exceeds the bias, wherein the relief valve and inlet check valve share a common pathway so that emission of fluid through the relief valve can clear debris that is impeding flow of fluid from the well reservoir to the cylinder during upstroke of the piston.

20. The gas well dewatering system of claim 19, wherein the piston pump comprises a dual acting piston having upper and lower piston heads and wherein upper and lower fluid chambers are defined by the cylinder and the respective upper and lower piston heads.

21. The gas well dewatering system of claim 20, comprising a lower inlet check valve allowing flow of fluid from the well fluid reservoir to the lower fluid chamber during upstroke of the piston and a lower outlet check valve allowing flow of fluid from the lower fluid chamber during downstroke of the piston.

22. The gas well dewatering system of claim 21, comprising an upper inlet check valve allowing flow of fluid from the well fluid reservoir to the upper fluid chamber during downstroke of the piston and an upper outlet check valve allowing flow of fluid from the upper fluid chamber during upstroke of the piston.

23. The gas well dewatering system of claim 22, wherein the relief valve is biased into the closed position by a spring.

24. The gas well dewatering system of claim 23, wherein the relief valve comprises an upstroke relief valve and a downstroke relief valve.

25. The gas well dewatering system of claim 24, wherein the downstroke relief valve is disposed in a through-bore that extends from the upper fluid chamber to the lower fluid chamber, the downstroke relief valve biased into a closed position and opening when the pressure in the upper fluid chamber exceeds the bias.

26. The gas well dewatering system of claim 25, wherein the downstroke relief valve is disposed in the piston between the upper and lower piston heads.

27. The gas well dewatering system of claim 25, wherein the upstroke relief valve shares a common pathway with the lower inlet check valve.

28. The gas well dewatering system of claim 19, comprising a screen on the common pathway for collecting debris.

29. The gas well dewatering system of claim 28, wherein the screen comprises a basket that is coupled to the piston pump such that the basked is removed from the well when the piston pump is removed from the well.

30. A gas well dewatering system having overpressure protection, the gas well dewatering system comprising:

a gas well extending underground from a surface, the gas well having an elongated well casing that circumscribes a length of tubing;

a pump connected to the length of tubing a configured to pump well fluid from an annulus in the well to the tubing for discharge from the well;

a casing head located at the surface of the well and having a discharge for emitting gas from the annulus, a tubing head located at the surface of the well and having a discharge for emitting water from the tubing, a conduit connecting the interior of the tubing head to the annulus in the casing;

a relief valve in the conduit, the relief valve biased into a closed position and configured to open upon an increase in pressure in the tubing beyond the bias pressure.

31. The gas well dewatering system of claim 30, further comprising an isolation valve disposed in the conduit between the relief valve and the tubing head.

* * * * *